US008662208B2

(12) United States Patent
Stroud et al.

(10) Patent No.: US 8,662,208 B2
(45) Date of Patent: Mar. 4, 2014

(54) DOWNHOLE CUTTING TOOL, CUTTING ELEMENTS AND METHOD

(75) Inventors: Donald Stuart Stroud, Tomball, TX (US); Donald Gregory Stroud, Tomball, TX (US)

(73) Assignee: American National Carbide Co., Tomball, TX (US)

( * ) Notice: Subject to any disclaimer, the term of this patent is extended or adjusted under 35 U.S.C. 154(b) by 376 days.

(21) Appl. No.: 13/013,639

(22) Filed: Jan. 25, 2011

(65) Prior Publication Data

US 2011/0308865 A1 Dec. 22, 2011

Related U.S. Application Data

(60) Provisional application No. 61/356,036, filed on Jun. 17, 2010.

(51) Int. Cl.
*E21B 10/62* (2006.01)

(52) U.S. Cl.
USPC ..... 175/428; 175/403; D15/138

(58) Field of Classification Search
USPC ..... 175/413, 432, 428, 403, 405.1; 407/113–115; D15/139, 138; 408/206, 408/223, 211, 212
See application file for complete search history.

(56) References Cited

U.S. PATENT DOCUMENTS 1,846,177 A * 2/1932 Bascom et al. ..... 175/323
2,710,180 A * 6/1955 Graham ..... 299/103
2,729,427 A * 1/1956 Davis et al. ..... 175/405.1
2,840,348 A * 6/1958 Tilden ..... 175/394
2,856,157 A * 10/1958 Chapin et al. ..... 175/394
3,027,952 A * 4/1962 Brooks ..... 175/434
3,091,138 A * 5/1963 Berry, Jr. ..... 408/232
3,229,349 A * 1/1966 Leksell ..... 407/113
3,331,455 A * 7/1967 Anderson, Jr. et al. ..... 175/403
D210,975 S * 5/1968 Blau ..... D15/139
3,563,325 A * 2/1971 Miller ..... 175/420.1
3,692,127 A * 9/1972 Hampe et al. ..... 175/405.1
3,694,876 A * 10/1972 Erkfritz ..... 407/48
4,056,152 A * 11/1977 Lacey ..... 175/405.1
4,143,920 A * 3/1979 Haddock ..... 299/112 R
D255,800 S * 7/1980 Kendra ..... D15/139
4,373,593 A * 2/1983 Phaal et al. ..... 175/430
4,457,765 A * 7/1984 Wilson ..... 51/293
4,556,345 A 12/1985 Philippi
4,821,465 A * 4/1989 Tomlinson et al. ..... 451/41

(Continued)

OTHER PUBLICATIONS

Photograph of Concave Mill 1 tool.

(Continued)

*Primary Examiner* — Kenneth L Thompson
(74) *Attorney, Agent, or Firm* — Lewis Brisbois Bisgaard & Smith LLP; Jon E. Hokanson; Josephine A. Brosas

(57) ABSTRACT

A cutting tool that has a leading or cutting surface that includes affixed thereto a plurality of irregular nine-faced polyhedrons or three-dimensional solid elements with nine faces, wherein each of the nine faces is a polygon and has a predetermined distance from each face to an opposing cutting edge and wherein the predetermined distance from each of the nine faces to its opposing cutting edge is equal for all of each of the nine faces, such that regardless of which of the nine faces is resting on a flat surface, the predetermined distance is the same.

17 Claims, 11 Drawing Sheets

(56) References Cited

U.S. PATENT DOCUMENTS

| | | | | |
|---|---|---|---|---|
| 5,007,775 | A * | 4/1991 | Pantzar | 407/113 |
| 5,020,944 | A * | 6/1991 | Pawlik | 407/42 |
| 5,067,858 | A | 11/1991 | Cook | |
| 5,113,919 | A * | 5/1992 | MacLennan | 144/34.1 |
| 5,218,888 | A * | 6/1993 | Merrill | 76/108.1 |
| 5,644,965 | A * | 7/1997 | MacLennan et al. | 83/842 |
| 5,908,071 | A | 6/1999 | Hutchinson et al. | |
| 5,951,215 | A | 9/1999 | Paya et al. | |
| 6,167,958 | B1 | 1/2001 | Lynde | |
| 6,170,576 | B1 | 1/2001 | Brunnert et al. | |
| 6,464,434 | B2 | 10/2002 | Lynde | |
| 6,604,893 | B2 * | 8/2003 | Nelson | 407/35 |
| 6,712,562 | B2 | 3/2004 | Svensson | |
| 6,769,343 | B2 * | 8/2004 | DiSabatino | 83/835 |
| 7,278,805 | B2 | 10/2007 | Ley | |
| 7,373,994 | B2 * | 5/2008 | Tchakarov et al. | 175/58 |
| 7,597,510 | B2 | 10/2009 | Lundvall | |
| 7,607,867 | B2 | 10/2009 | Benson | |
| 7,611,312 | B2 * | 11/2009 | Miyanaga | 408/204 |
| 7,984,773 | B2 * | 7/2011 | Oothoudt | 175/403 |
| D647,117 | S * | 10/2011 | Omi | D15/139 |
| 2004/0253063 | A1 | 12/2004 | Murrell | |
| 2006/0257216 | A1 | 11/2006 | Kimura et al. | |
| 2007/0140802 | A1 * | 6/2007 | Locke | 408/204 |

OTHER PUBLICATIONS

Photograph of Concave Mill 2 tool.
Photograph of Fishing Mill tool.
Photograph of Pilot Mill tool.
Photograph of Section Mill tool.
Photograph of String Taper Mill tool.
Photograph of Tapered Mill tool 2.
Photograph of Tapered Mill tool 3.
Photograph of Watermelon Mill tool.
Photograph of Whipstock Mill tool.
Photograph of Window Mill tool.

* cited by examiner

DOWNHOLE CUTTING TOOL, CUTTING ELEMENTS AND METHOD

CROSS REFERENCE TO RELATED APPLICATION

This application claims the benefit of U.S. provisional patent application Ser. No. 61/356,036, filed Jun. 17, 2010, the entirety of which is incorporated by reference herein.

FIELD OF INVENTION

The invention relates generally to downhole cutting tools, cutting inserts or elements used in such tools and methods of cutting, milling, or removing downhole items made of concrete, plastic, or other material, such as metal chips and casing strings in a well bore, including other types of passages through which fluid flows.

BACKGROUND

Downhole cutting tools and cutting elements are well known in the oil drilling industry. For example, U.S. Pat. No. 6,464,434 is directed to products and methods that are used in fishing tools, but it does not disclose structures or advantages that are provided by the structures disclosed herein. One of the drawbacks of known cutting tools and cutting elements is non-uniformity of the height of the elements when they are packed together or applied to a cutting tool surface, thus resulting in a relatively inefficient cutting tool because of the height variation.

SUMMARY

The cutting elements and cutting tools described herein overcome drawbacks of known cutting elements, cutting tools, and methods of manufacture and use by providing cutting elements that can be applied randomly but are the same height any way they are oriented on the tool's surface. They result in significant advantages in cutting efficiency, in manufacturing and in use of tools that incorporate these cutting elements. Proper orientation during manufacturing is automatic and easily achieved, thus allowing for lower manufacturing costs, and wear on the tool during use downhole is more even, thus resulting in a longer useful life of the cutting tool.

The preferred embodiment of the cutting element described herein is generally comprised of an irregular polyhedron having nine faces and a plurality of cutting edges. These nine faces have predetermined sizes, shapes, edges and spatial relationships. Each of the nine faces has a predetermined distance from its face to a cutting edge opposite to that face. This predetermined distance from each face to its opposing cutting edge is equal for all of the nine faces, such that regardless of which of the nine faces rest on a flat surface, its opposing cutting edge is the same distance from that face.

These and other embodiments, features, aspects, and advantages of the invention will become better understood with regard to the following description, appended claims and accompanying drawings.

BRIEF DESCRIPTION OF THE DRAWINGS

The foregoing aspects and the attendant advantages of the present invention will become more readily appreciated by reference to the following detailed description, when taken in conjunction with the accompanying drawings, wherein:

FIG. 14A-1 is a side elevation view of the FIG. 1 embodiment, wherein the element is resting on a flat surface on its first face as shown in FIG. 5;

FIG. 14A-2 is a side elevation view of the FIG. 1 embodiment wherein the element is resting on a flat surface on its second face as shown in FIG. 6;

FIG. 14A-3 is a side elevation view of the FIG. 1 embodiment wherein the element is resting on a flat surface on its third face as shown in FIG. 7;

FIG. 14B-1 is a side elevation view of the FIG. 1 embodiment, wherein the element is resting on a flat surface on its fourth face as shown in FIG. 8;

FIG. 14B-2 is a side elevation view of the FIG. 1 embodiment, wherein the element is resting on a flat surface on its fifth face as shown in FIG. 9;

FIG. 14B-3 is a side elevation view of the FIG. 1 embodiment, wherein the element is resting on a flat surface on its sixth face as shown in FIG. 10;

FIG. 14C-1 is a side elevation view of the FIG. 1 embodiment, wherein the element is resting on a flat surface on its seventh face as shown in FIG. 11;

FIG. 14C-2 is a side elevation view of the FIG. 1 embodiment, wherein the element is resting on a flat surface on its eighth face as shown in FIG. 12;

FIG. 14C-3 is a side elevation view of the FIG. 1 embodiment, wherein the element is resting on a flat surface on its ninth face as shown in FIG. 13;

Reference symbols or names are used in the figures to indicate certain components, aspects or features shown therein. Reference symbols common to more than one figure indicate like components, aspects or features shown therein.

DETAILED DESCRIPTION

With reference to FIGS. 1-18, preferred embodiments of the cutting elements incorporated in and used during operation of cutting tools will be described. The cutting elements are preferably made of tungsten carbide that is affixed via welding, bonding, or brazing to a downhole tool used for cutting through unwanted material in a drilled hole primarily for an oil or gas well. In other embodiments, these cutting elements may be affixed via welding, bonding, or brazing onto a plate or a bar which is detachably mounted or fastened onto the cutting tool. The plate or bar may also be affixed to the cutting tool via welding, bonding or brazing.

A cutting tool typically has a front portion and a rear portion. A plurality of cutting elements is preferably affixed onto a leading surface of the front portion of the cutting tool. During operation of the tool the elements cut through the unwanted material, or material which otherwise needs to be removed from a well bore or passage. The unwanted material to be cut through in such environments typically includes concrete casing strings, metal chips, drill pipe aggregates, plugs, and other trash. The terms typically used in the industry to describe this type of downhole tool are "junk mill," "casing mill," and "fishing tool."

During normal use, cutting tools, which incorporate a plurality of the cutting elements described herein, are lowered or otherwise inserted into wells or pipes, and then rotated and forced downward with the front portion of the tool adapted to cut through unwanted material.

As shown in FIGS. 1-4 the preferred cutting element 100 is an irregular or modified nonahedron or enneahedron, that is, a three-dimensional solid element with nine faces. FIGS. 5 through 13 show all of the nine faces of the preferred cutting element wherein each face is outlined in heavy line.

Figure 1:
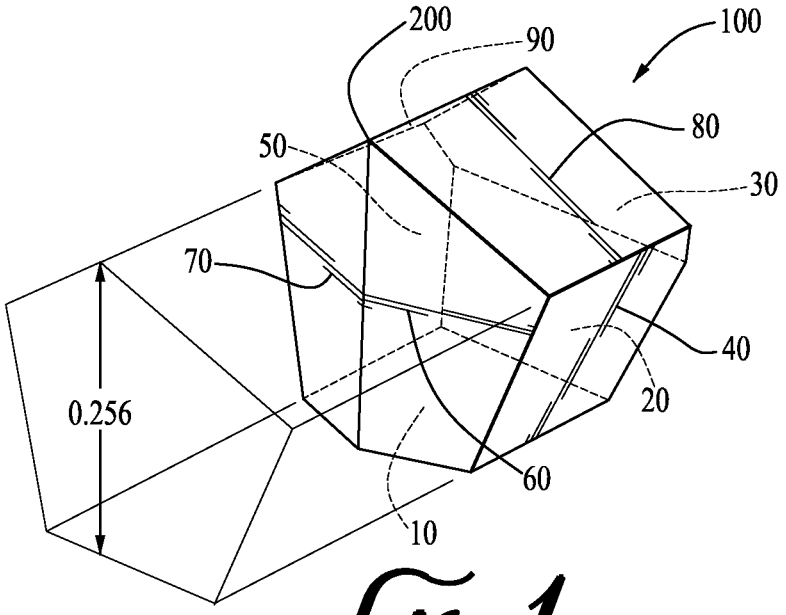
FIG. 1 is a perspective view of a preferred embodiment of a cutting element for use in a preferred embodiment cutting tool and method of use.
Figure 2:
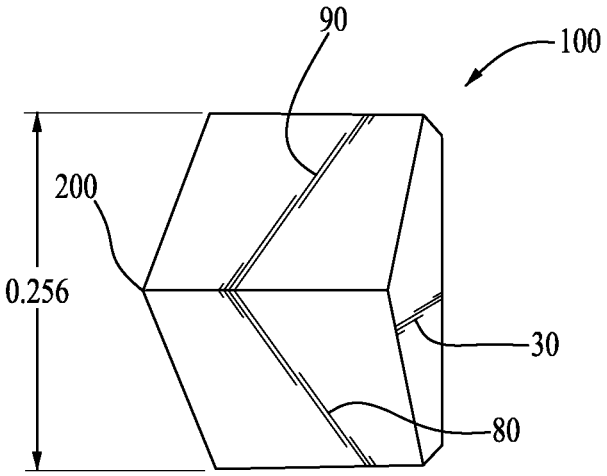
FIG. 2 is a top view of the FIG. 1 embodiment wherein the element is resting on one of its faces.
Figure 4:
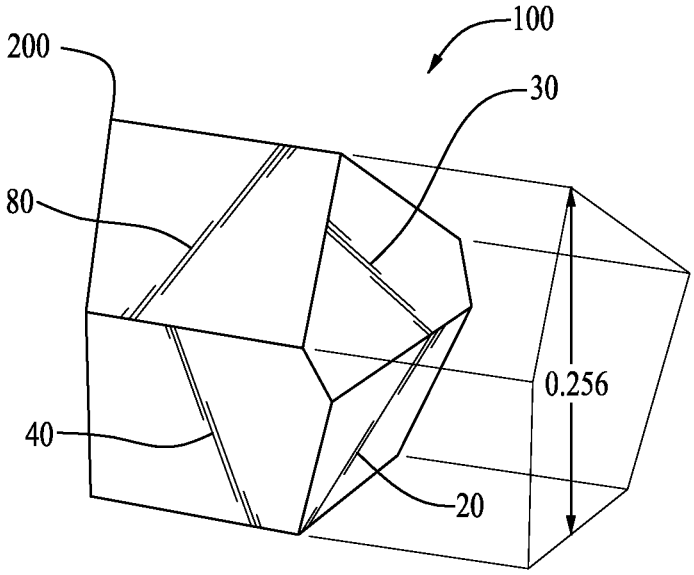
FIG. 4 is a perspective view of the FIG. 1 embodiment with the element shown from a view which is opposite to that shown in FIG. 1.

As shown in FIGS. 1, 2, and 4, the nominal height of the preferred embodiment when measured from a flat or horizontal surface on which it is resting, to its peak 200, is preferably 0.256 inch. This is the predetermined distance from the face resting on a flat or horizontal surface, to a cutting edge opposite to this face. This height or distance, however, can be varied, so long as the height of the element from the face to its opposed cutting edge is the same regardless of which face or surface of the element is welded or otherwise fastened to the front portion of the cutting tool. As shown in FIG. 1, the preferred embodiment of the cutting element 100 has nine faces with predetermined sizes, shapes, and spatial relationships: It has a first face 10, a second face 20, a third face 30, a fourth face 40, a fifth face 50, a sixth face 60, a seventh face 70, an eighth face 80, and a ninth face 90.

The cutting elements may be manufactured in heights greater than or less than 0.256 inch, for example, from a height of 0.150 inch or greater, as is needed based on the type of drilling or well boring application. As will be appreciated by those skilled in this field, the height of all the cutting elements will be equal for a given tool, but tools having different gauges may be made using batches of cutting elements, with the cutting element heights the same in each batch, but the heights variable from batch to batch.

Figure 5:
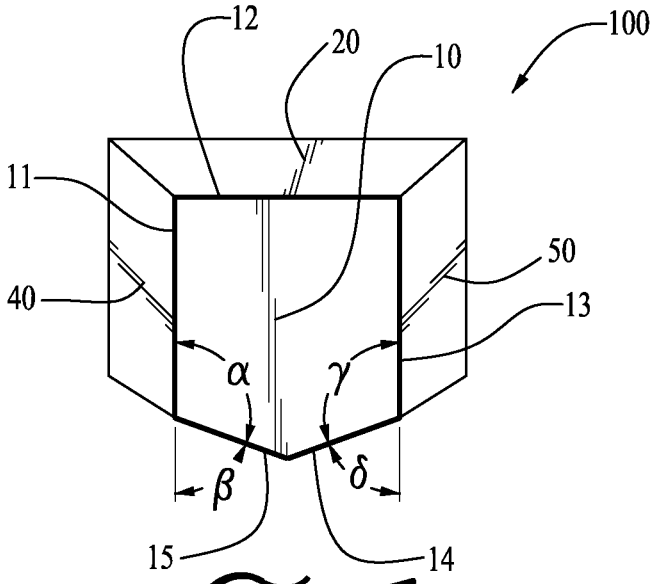
FIG. 5 is a top view of a first face of the FIG. 1 embodiment, wherein the first face is outlined in heavy line, and wherein the first face is on the same plane as the plane of the page.

Referring now to the top view of the cutting element as shown in FIG. 5, the cutting element 100 has a first face 10, forming a pentagon with cutting edges 11, 12, 13, 14 and 15. Cutting edge 15 is offset at angle $\alpha$, which is substantially a 110° angle with respect to cutting edge 11, with an adjacent angle $\beta$, which is substantially a 70° angle. Cutting edge 14 is offset at angle $\gamma$, which is substantially a 110° angle with respect to cutting edge 13, with an adjacent angle $\delta$, which is substantially a 70° angle.

Figure 6:
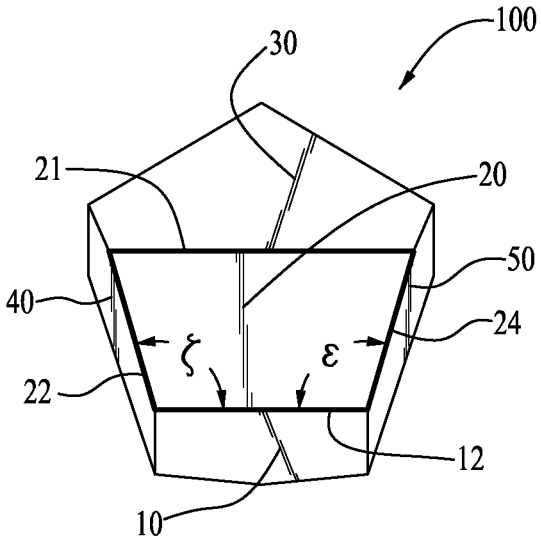
FIG. 6 is a top view of a second face of the FIG. 1 embodiment, wherein the second face is outlined in heavy line, and wherein the second face is on the same plane as the plane of the page.

Referring to the top view of FIG. 6, the cutting element 100 has a second face 20, forming a trapezoid with cutting edges 12, 21, 22 and 24. As shown in FIGS. 5 and 6, cutting edge 12 extends along and joins the first face 10 and second face 20. Cutting edge 24 is offset at angle $\epsilon$, which is a substantially a 108° angle with respect to cutting edge 12. Similarly, cutting edge 22 is offset at angle $\zeta$, which is substantially a 108° angle with respect to cutting edge 12.

Figure 7:
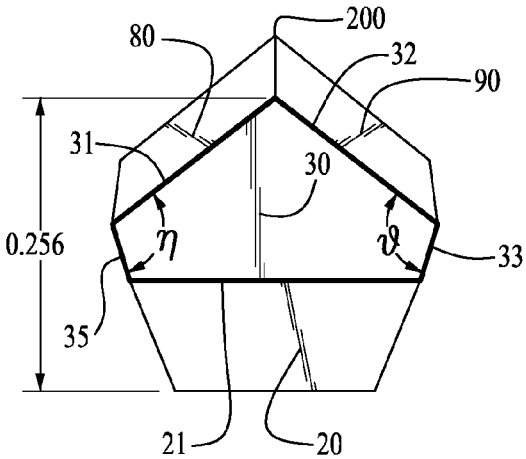
FIG. 7 is a top view of a third face of the FIG. 1 embodiment, wherein the third face is outlined in heavy line, and wherein the third face is on the same plane as the plane of the page.

Referring to the top view of FIG. 7, the cutting element has a predetermined distance of 0.256 inch when rested on and measured from a flat or horizontal surface, to its peak 200. The cutting element has a third face 30, forming a pentagon with cutting edges 21, 31, 32, 33 and 35. As shown in FIGS. 6 and 7, cutting edge 21 extends along and joins the second face 20 and third face 30. Cutting edge 31 is offset at angle $\eta$, which is substantially a 108° angle with respect to cutting edge 35. Similarly, cutting edge 32 is offset at angle $\theta$, which is substantially a 108° angle with respect to cutting edge 33.

Figure 8:
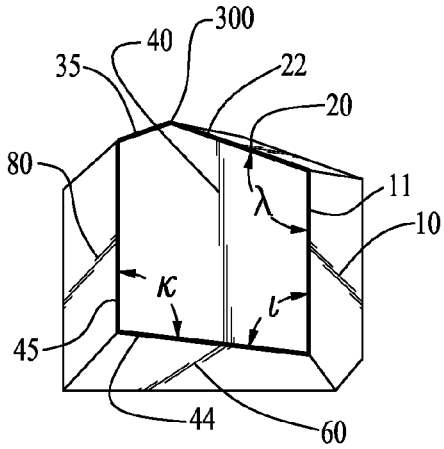
FIG. 8 is a top view of a fourth face of the FIG. 1 embodiment, wherein the fourth face is outlined in heavy line, and wherein the fourth face is on the same plane as the plane of the page.

Referring to the top view of FIG. 8, the cutting element has a fourth face 40, forming an irregular pentagon with cutting edges 11, 22, 35, 44 and 45. The cutting element has a predetermined distance of 0.256 inch when rested on and measured from a flat or horizontal surface, to its peak 300. As shown in FIGS. 5 and 8, cutting edge 11 extends along and joins the first face 10 and the fourth face 40. As shown in FIGS. 6 and 8, cutting edge 22 extends along and joins the second face 20 and the fourth face 40. As shown in FIGS. 7 and 8, cutting edge 35 extends along and joins the third face 30 and the fourth face 40. Cutting edge 11 is offset at angle $\iota$, which is substantially an 83° angle with respect to cutting edge 44. Cutting edge 45 is offset at angle $\kappa$, which is substantially a 97° angle with respect to cutting edge 44. Cutting edge 22 is offset at angle $\lambda$, which is substantially a 109° angle with respect to cutting edge 11.

Figure 9:
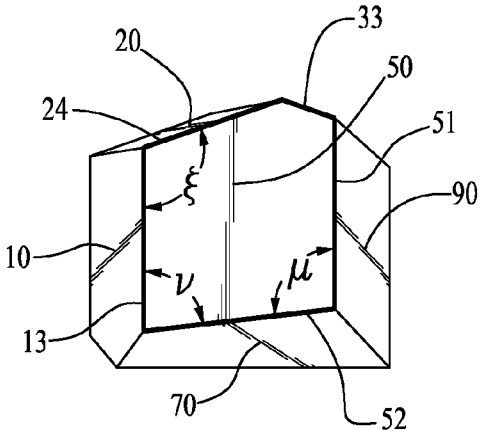
FIG. 9 is a top view of a fifth face of the FIG. 1 embodiment, wherein the fifth face is outlined in heavy line, and wherein the fifth face is on the same plane as the plane of the page.

Referring to the top view of FIG. 9, the cutting element has a fifth face 50, forming an irregular pentagon with cutting edges 13, 24, 33, 51 and 52. As shown in FIGS. 5 and 9, cutting edge 13 extends along and joins the first face 10 and fifth face 50. As shown in FIGS. 6 and 9, cutting edge 24 extends along and joins the second face 20 and fifth face 50. As shown in FIGS. 7 and 9, cutting edge 33 extends along and joins the third face 30 and fifth face 50. Cutting edge 51 is offset at angle μ, which is substantially a 97° angle with respect to cutting edge 52. Cutting edge 13 is offset at angle ν, which is substantially an 83° angle with respect to cutting edge 52. Cutting edge 24 is offset at angle ξ, which is substantially a 109° angle with respect to cutting edge 13.

Figure 10:
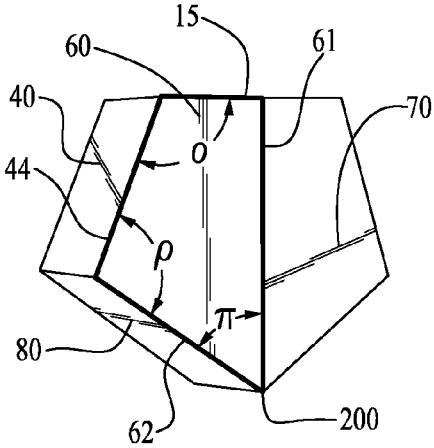
FIG. 10 is a top view of a sixth face of the FIG. 1 embodiment, wherein the sixth face is outlined in heavy line, and wherein the sixth face is on the same plane as the plane of the page.

Referring to the top view of FIG. 10, the cutting element has a sixth face 60, forming an irregular quadrilateral with cutting edges 15, 44, 61, and 62. Cutting edge 44 is offset at angle ο, which is substantially a 108° angle with respect to cutting edge 15. As shown in FIGS. 5 and 10, cutting edge 15 extends along and joins the first face 10 and the sixth face 60. As shown in FIGS. 8 and 10 cutting edge 44 extends along and joins the fourth face 40 and the sixth face 60. Cutting edge 61 is offset at angle π, which is substantially a 57° angle with respect to cutting edge 62. Cutting edge 44 is offset at angle ρ, which is substantially a 104° angle with respect to cutting edge 62.

Figure 11:
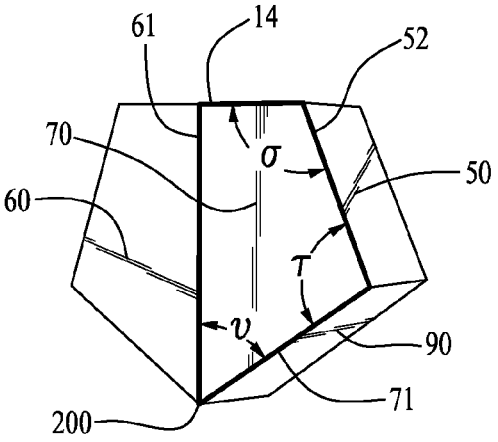
FIG. 11 is a top view of a seventh face of the FIG. 1 embodiment, wherein the seventh face is outlined in heavy line, and wherein the seventh face is on the same plane as the plane of the page.

Referring to the top view of FIG. 11, the cutting element has a seventh face 70, forming an irregular quadrilateral with cutting edges 14, 52, 61 and 71. Cutting edge 52 is offset at angle σ, which is substantially a 108° angle with respect to cutting edge 14. As shown in FIGS. 5 and 11, cutting edge 14 extends along and joins the first face 10 and the seventh face 70. As shown in FIGS. 9 and 11, cutting edge 52 extends along and joins the fifth face 50 and the seventh face 70. As shown in FIGS. 10 and 11 cutting edge 61 extends along and joins the sixth face 60 and the seventh face 70. Cutting edge 52 is offset at angle τ, which is substantially a 104° angle with respect to cutting edge 71. Cutting edge 61 is offset at angle υ, which is substantially a 57° angle with respect to cutting edge 71.

Figure 12:
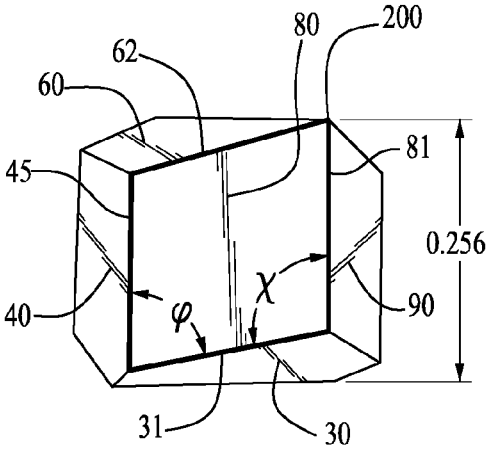
FIG. 12 is a top view of an eighth face of the FIG. 1 embodiment, wherein the eighth face is outlined in heavy line, and wherein the eighth face is on the same plane as the plane of the page.
Figure 13:
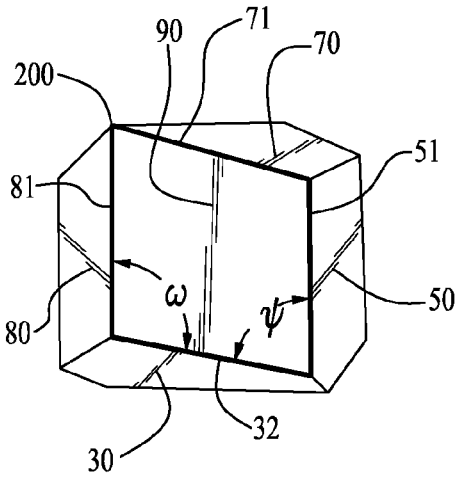
FIG. 13 is a top view of the ninth face of the FIG. 1 embodiment, wherein the ninth face is outlined in heavy line, and wherein the ninth face is on the same plane as the plane of the page.

Referring to the top view of FIG. 12, the cutting element has an eighth face 80, forming an irregular quadrilateral with cutting edges 62, 81, 31 and 45. The cutting element has a predetermined distance of 0.256 inch when rested on and measured from a flat or horizontal surface, to its peak 200. As shown in FIGS. 10 and 12, cutting edge 62 extends along and joins the sixth face 60 and the eighth face 80. As shown in FIGS. 12 and 13, cutting edge 81 extends along and joins the ninth face 90 and the eighth face 80. As shown in FIGS. 7 and 12, cutting edge 31 extends along and joins the third face 30 and the eighth face 80. Cutting edge 45 is offset at angle φ, which is substantially a 78° angle with respect to cutting edge 31. Cutting edge 81 is offset at angle χ, which is substantially a 101° angle with respect to cutting edge 31.

Referring to the top view of FIG. 13, the cutting element has a ninth face 90, forming an irregular quadrilateral with cutting edges 71, 81, 32 and 51. The cutting element has a predetermined distance of 0.256 inch when rested on and measured from a flat or horizontal surface, to its peak 200. As shown in FIGS. 11 and 13, cutting edge 71 extends along and joins the seventh face 70 and the ninth face 90. As shown in FIGS. 12 and 13, cutting edge 81 extends along and joins the eighth face 80 and the ninth face 90. As shown in FIGS. 7 and 13, cutting edge 32 extends along and joins the third face 30 and the ninth face 90. As shown in FIGS. 9 and 13, cutting edge 51 extends along and joins the fifth face and the ninth face 90. Cutting edge 51 is offset at angle ψ, which is substantially a 78° angle with respect to cutting edge 32. Cutting edge 81 is offset at angle ω, which is substantially a 101° angle with respect to cutting edge 32.

Figure 3:
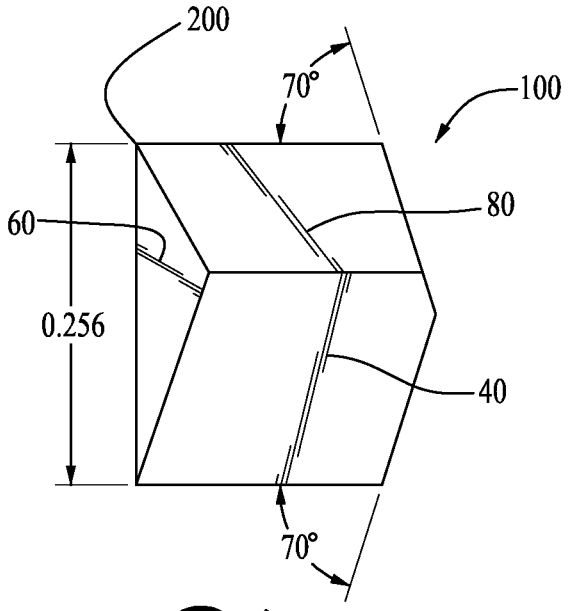
FIG. 3 is a side elevation view of the FIG. 1 embodiment wherein the element is resting on another one of its faces.
Figures 1, 2, 3, 14A, 14B, 14C:
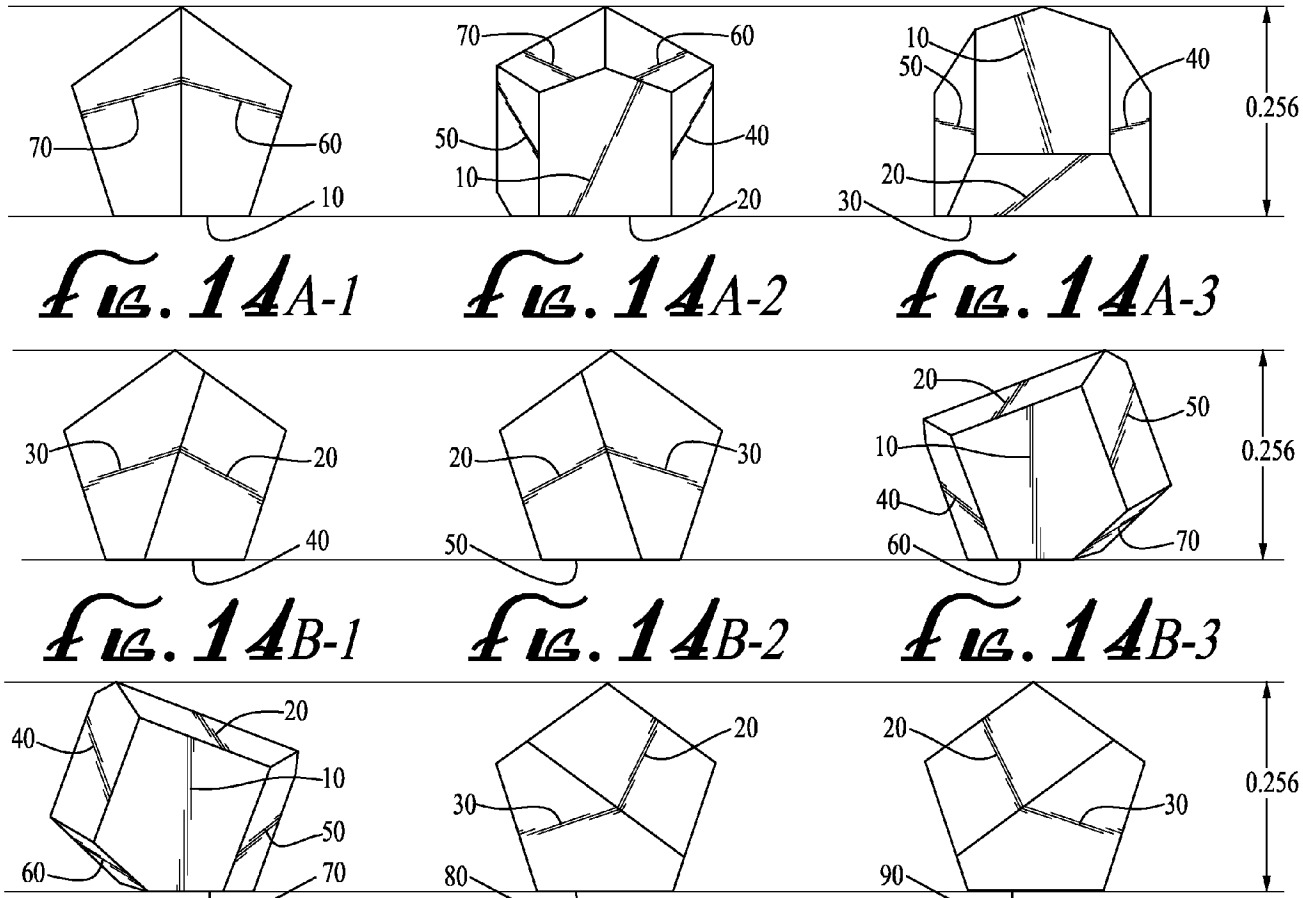

Referring to FIG. 14A, this shows the side elevation views of the element resting on a flat or horizontal surface. FIG. 14A-1 shows the element resting on its first face 10 which is shown in FIG. 5. FIG. 14A-2 shows the element resting on its second face 20 which is shown in FIG. 6. FIG. 14A-3 shows the element resting on its third face 30 which is shown in FIG. 7. As shown in FIG. 14A, the nominal height of the elements when resting on a flat or horizontal surface is a preferred height of 0.256 inch, which is the distance from the face resting on a flat or horizontal surface, to a respective cutting edge opposite to said face. Thus, the height of the element is the same regardless of which face or surface is welded or otherwise fastened to the tool.

Referring to FIG. 14B, this shows the side elevation views of the element resting on a flat or horizontal surface. FIG. 14B-1 shows the element resting on its fourth face 40 which is shown in FIG. 8. FIG. 14B-2 shows the element resting on its fifth face 50 which is shown in FIG. 9. FIG. 14B-3 shows the element resting on its sixth face 60 which is shown in FIG. 10. As shown in FIG. 14B, just as in FIG. 14A, the nominal height of the elements when resting on a flat or horizontal surface is a preferred height of 0.256 inch, which is the distance from the face resting on a flat or horizontal surface, to a respective cutting edge opposite to said face. Thus, the height of the element is the same regardless of which face or surface is welded, bonded, or otherwise fastened to the tool.

Figure 15:
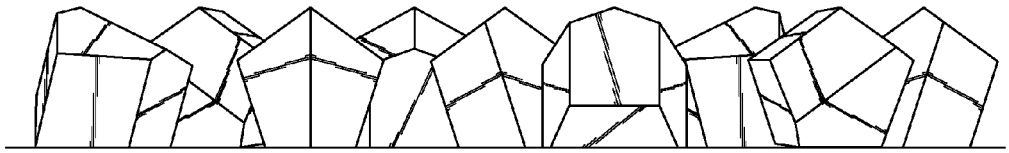
FIG. 15 is a side elevation view of a plurality of the FIG. 1 elements at rest on a flat surface.
Figure 16:
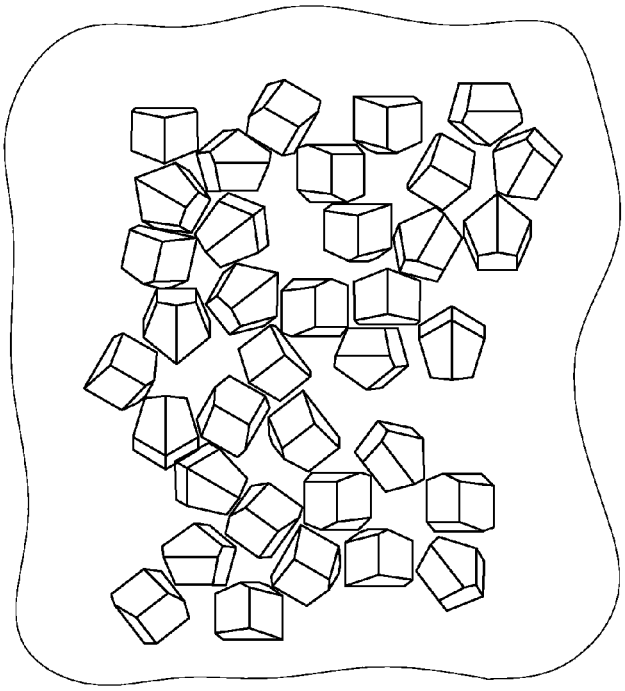
FIG. 16 is a top view of a plurality of elements as shown in FIG. 15.

Referring to FIG. 14C, this shows the side elevation views of the element resting on a flat or horizontal surface. FIG. 14C-1 shows the element resting on its seventh face 70 which is shown in FIG. 11. FIG. 14C-2 shows the element resting on its eighth face 80 which is shown in FIG. 12. FIG. 14C-3 shows the element resting on its ninth face 90 which is shown in FIG. 13. As shown in FIGS. 14A, 14B, and 14C, the nominal height of the elements when resting on a flat or horizontal surface is a preferred height of 0.256 inch, which is the distance from the face resting on a flat or horizontal surface, to a respective cutting edge opposite to said face. Thus, the height of the element is the same regardless of which of the nine faces or surfaces is welded, bonded, or otherwise fastened to the tool. As also shown in the images of FIGS. 15 and 16, even with the random placement of a plurality of cutting elements on a flat or horizontal surface, the height of the elements remain the same.

Figure 17:
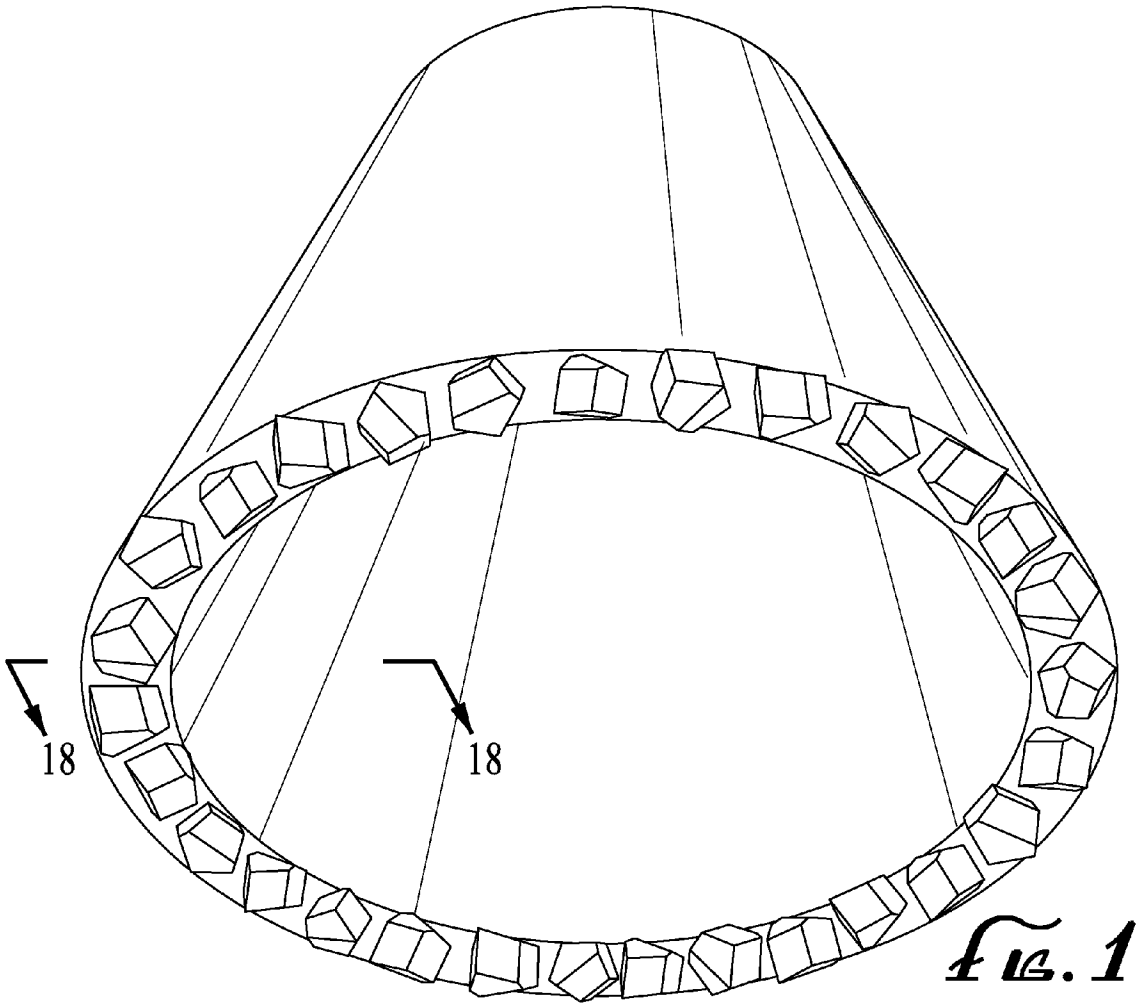
FIG. 17 is a perspective view of the front portion of a cutting tool having a plurality of cutting elements affixed thereto.
Figure 18:
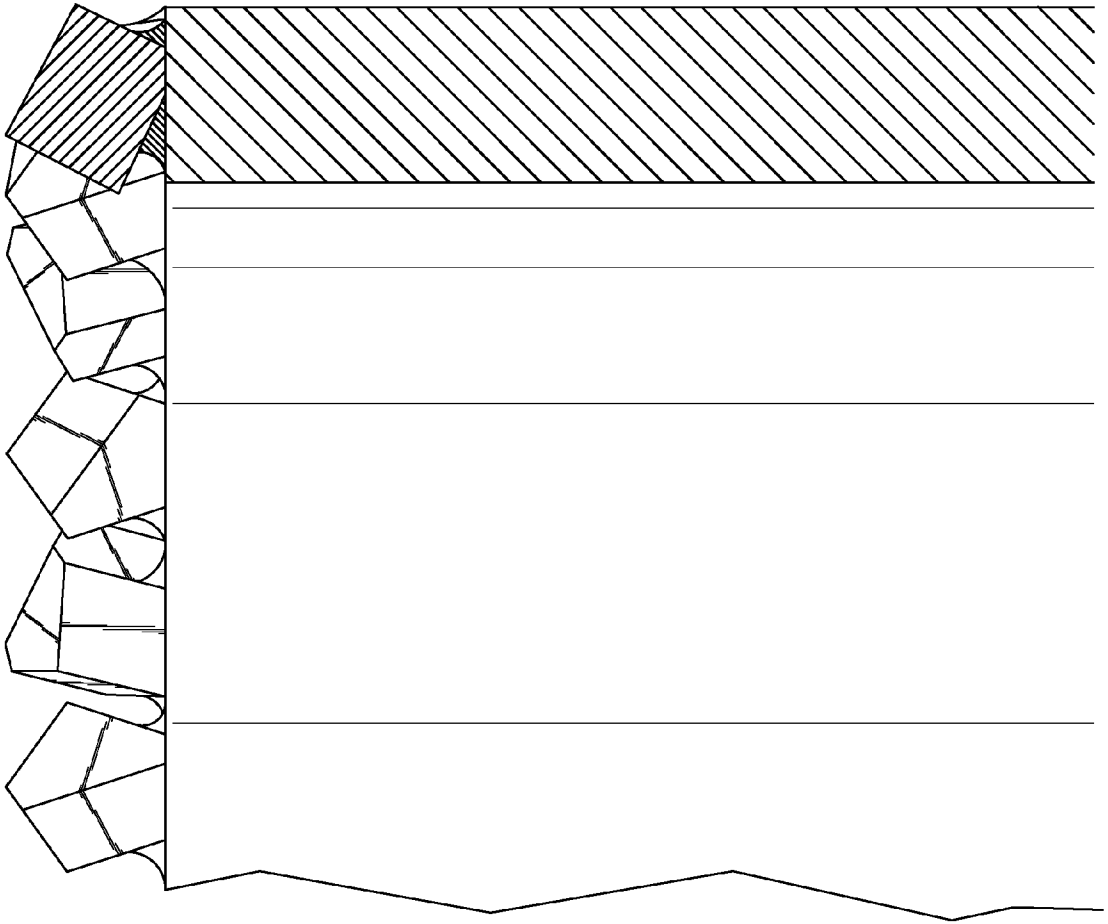
FIG. 18 is a side view of the cutting tool shown in FIG. 17.

As shown in FIGS. 17 and 18, the preferred cross-sectional shape of the tool is circular, that is, a round tool similar to a pipe or rod. The cutting elements are then affixed to the front portion of the tool to create a tool cutting surface, or leading surface. The cutting elements described herein can be used for virtually all conventional tools, such as, by way of example, concave mills, fishing mills, pilot mills, section mills, string taper mills, taper mills, watermelon mills, whipstock mills, window mills, casing scrapers, casing shoes, and chip casing shoes.

As noted above, the cutting elements may be manufactured with a predetermined distance from one face, to the opposing cutting edge, of greater than or less than 0.256 inch, so long as the heights of the cutting elements protruding from a cutting tool are equal for a given tool. However, cutting tools having different gauges may be made using batches of cutting elements, with the cutting element heights the same in each batch, but the heights variable from batch to batch.

As is apparent from the above description and figures, no matter how the cutting element lays on the tool, it always has a sharp cutting edge facing outward or up in order to provide a cutting edge which cuts through the unwanted material. Thus, any of the nine faces of the cutting element can be welded, bonded, or otherwise fastened to the front portion of a tool, but the distance from any of such nine faces to its respective opposing cutting edge, is the same. This is a significant advantage because it reduces the time it takes to apply the cutting elements, which enables the placement of a plurality of cutting elements in a random fashion. No careful alignment is necessary during the application process, whereas careful, time consuming and relatively expensive efforts are required when applying conventional cutting elements to a tool. In other words, traditionally engineered cutting products require careful alignment to ensure that the cutting elements are correctly positioned on the tool.

To further describe an advantage of the present cutting elements, as noted above, they are the same height any way they are oriented on the tool's front or leading surface. Therefore, achieving a particular gage height on the tool is automatic, and this step in the application process also reduces time needed to manufacture a fully dressed tool or as shown in FIGS. 17 to 18. Traditional cutting products, such as those using crushed sintered carbide have irregular shapes and sizes which make the gage difficult to control and the application time relatively long.

Additionally, the cutting elements described herein have included angles which are equal to or greater than 90 degrees. This geometry creates stronger edges than those elements having sharp, irregular edges. This geometry also results in less wear, thus allowing the product to maintain the gage height longer than traditional products.

Figure 19:
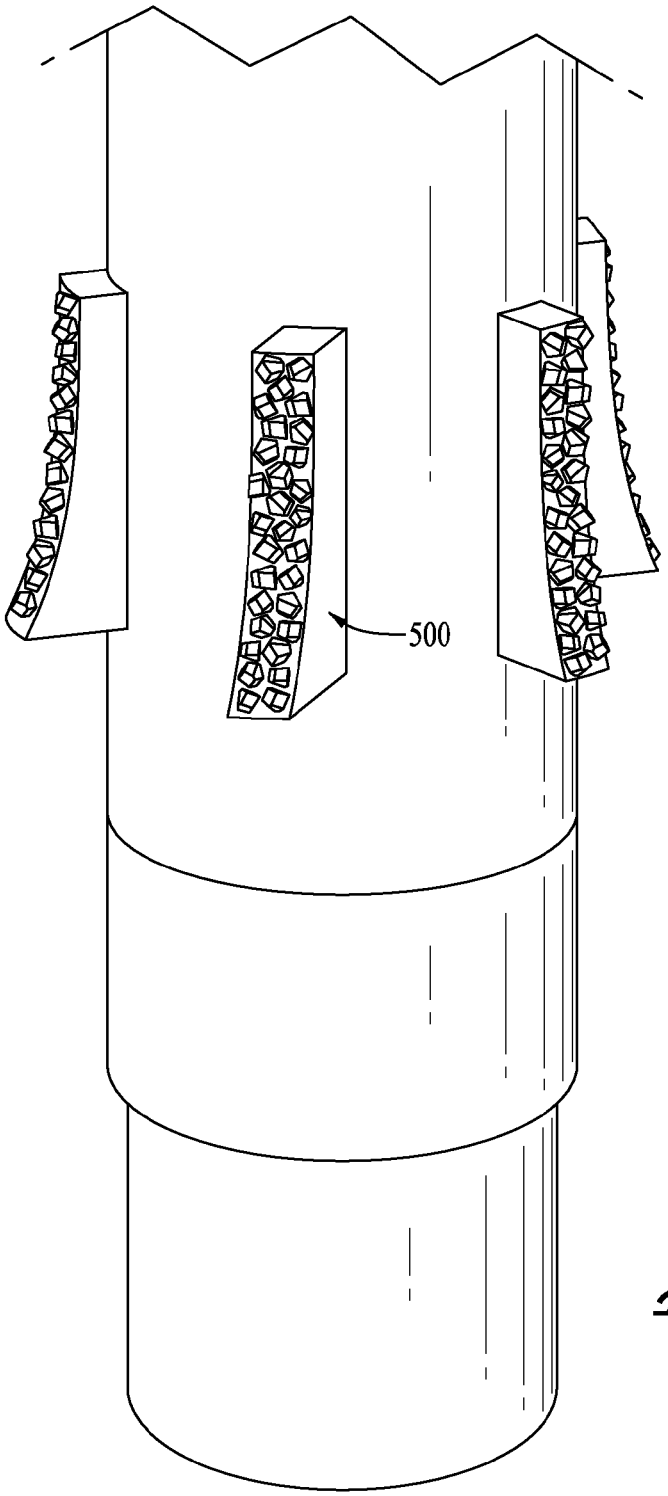
FIG. 19 is a side elevation view of a cutting tool with a plurality of cutting elements affixed onto a bar, wherein said bar is affixed onto said cutting tool.
Figure 20:
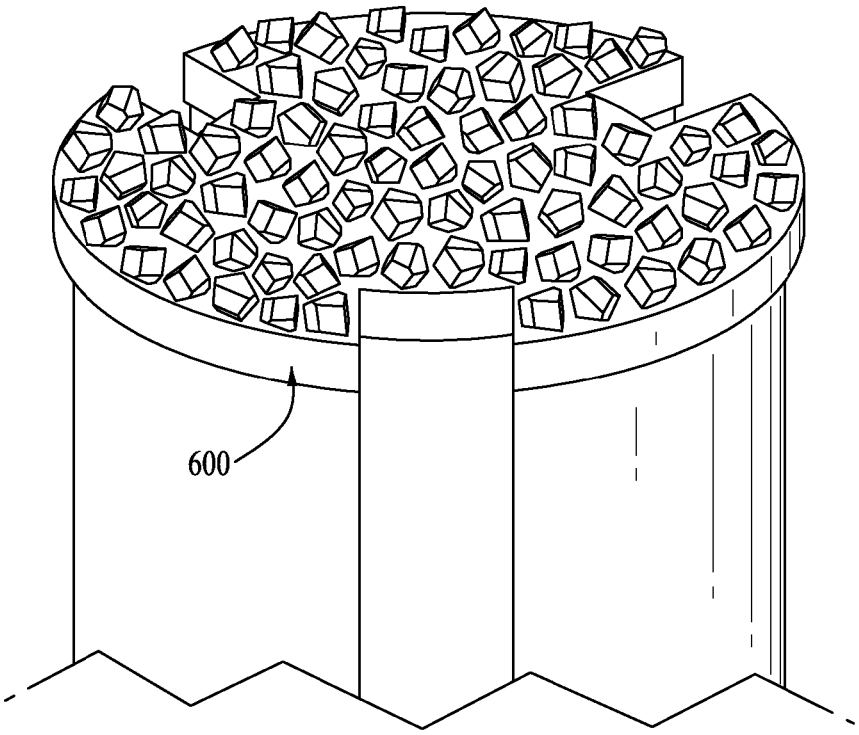
FIG. 20 is a perspective view of a cutting tool with a plurality of cutting elements affixed onto a plate, wherein said plate is affixed onto said cutting tool.

The cutting elements are made with, preferably, cutting grade tungsten carbide, and are preferably attached to the tool with conventional welding, bonding, or brazing techniques. The cutting elements can be incorporated into the cutting tool, through welding, bonding, or brazing of its faces to the tool, with random placement of such elements and without regard to their alignment or uniformity. As shown in FIGS. 19 and 20, cutting elements can also be welded or bonded to a metal bar (500) or plate (600), which is then welded, bonded, or otherwise fastened to the cutting tool. Regardless of the application, the finished tool will have a uniform cutting element height across the tool. Other grades of materials, with varying types of hardness measured in various scales (such as mos/scratch, rebound, and/or indentation hardness) and composition may also be used for the cutting elements.

Although specific embodiments of the invention have been described, various modifications, alterations, alternative constructions, and equivalents are also encompassed within the scope of the invention.

The specification and drawings are, accordingly, to be regarded in an illustrative rather than a restrictive sense. It will, however, be evident that additions, subtractions, deletions, and other modifications and changes may be made thereunto without departing from the broader spirit and scope of the invention as set forth in the claims.

What is claimed is:

1. A cutting element, comprising:

an irregular polyhedron having a first face, a second face, a third face, a fourth face, a fifth face, a sixth face, a seventh face, an eighth face, and a ninth face;

said first face having five cutting edges which form a pentagon comprising a first included angle $\alpha$ and a second included angle $\gamma$;

said second face having four cutting edges which form a trapezoid comprising a first included angle $\epsilon$ and a second included angle $\zeta$;

said third face having five cutting edges which form a pentagon comprising a first included angle $\eta$ and a second included angle $\theta$;

said fourth face having five cutting edges which form an irregular pentagon comprising a first included angle $\iota$, a second included angle $\kappa$ and a third included angle $\lambda$;

said fifth face having five cutting edges which form an irregular pentagon comprising a first included angle $\nu$, a second included angle $\mu$ and a third included angle $\xi$;

said sixth face having four cutting edges which form an irregular quadrilateral comprising a first included angle $\pi$, a second included angle $\rho$ and a third included angle $o$;

said seventh face having four cutting edges which form an irregular quadrilateral comprising a first included angle $\upsilon$, a second included angle $\tau$ and a third included angle $\sigma$;

said eighth face having four cutting edges which form an irregular quadrilateral comprising a first included angle $\phi$, a second included angle $\chi$;

said ninth face having four cutting edges which form an irregular quadrilateral comprising a first included angle $\psi$, a second included angle $\omega$;

each of said first through nine faces having a predetermined distance from each of said nine faces to an opposing cutting edge of each of said nine faces; and, said predetermined distance is equal for each of said nine faces.

2. The cutting element of claim 1 wherein said cutting element is made of tungsten carbide.

3. A down hole cutting tool comprising:

a longitudinal body having a leading surface;

a plurality of cutting elements is affixed onto said leading surface;

each of said cutting elements is an irregular polyhedron having a first face, a second face, a third face, a fourth face, a fifth face, a sixth face, a seventh face, an eighth face, and a ninth face;

said first face having five cutting edges which form a pentagon comprising a first included angle $\alpha$ and a second included angle $\gamma$;

said second face having four cutting edges which form a trapezoid comprising a first included angle $\epsilon$ and a second included angle $\zeta$;

said third face having five cutting edges which form a pentagon comprising a first included angle $\eta$ and a second included angle $\theta$;

said fourth face having five cutting edges which form an irregular pentagon comprising a first included angle $\iota$, a second included angle $\kappa$ and a third included angle $\lambda$;

said fifth face having five cutting edges which form an irregular pentagon comprising a first included angle $\nu$, a second included angle $\mu$ and a third included angle $\xi$;

said sixth face having four cutting edges which form an irregular quadrilateral comprising a first included angle $\pi$, a second included angle $\rho$ and a third included angle $o$;

said seventh face having four cutting edges which form an irregular quadrilateral comprising a first included angle $\upsilon$, a second included angle $\tau$ and a third included angle $\sigma$;

said eighth face having four cutting edges which form an irregular quadrilateral comprising a first included angle $\phi$, a second included angle $\chi$;

said ninth face having four cutting edges which form an irregular quadrilateral comprising a first included angle $\psi$, a second included angle $\omega$;

each of said first through nine faces having a predetermined distance from each of said nine faces to an opposing cutting edge of each of said nine faces; and, said predetermined distance is equal for each of said nine faces.

4. The cutting tool of claim 3 wherein said plurality of cutting elements have a uniform height across said leading surface of said cutting tool.

5. The cutting tool of claim 3 wherein said plurality of cutting elements have a variable height across said leading surface of said cutting tool.

6. The cutting tool of claim 3 wherein said plurality of cutting elements is affixed onto said leading surface of said longitudinal body by affixing said plurality of cutting elements to a metal bar and by affixing said bar onto said leading surface of said longitudinal body.

7. The cutting tool of claim 3 wherein said plurality of cutting elements is affixed onto said leading surface of said longitudinal body by affixing said plurality of cutting elements to a plate and by affixing said plate onto said leading surface of said longitudinal body.

8. A cutting element, comprising:

an irregular polyhedron having a first face, a second face, a third face, a fourth face, a fifth face, a sixth face, a seventh face, an eighth face, and a ninth face;

said first face having five cutting edges;

said second face having four cutting edges;

said third face having five cutting edges;

said fourth face having five cutting edges;

said fifth face having five cutting edges;

said sixth face having four cutting edges;

said seventh face having four cutting edges;

said eighth face having four cutting edges;

said ninth face having four cutting edges;

each of said first through nine faces having a predetermined distance from each of said nine faces to an opposing cutting edge of each of said nine faces; and, said predetermined distance is equal for each of said nine faces.

9. The cutting element of claim 8 wherein said cutting element is made of tungsten carbide.

10. A down hole cutting tool comprising:

a longitudinal body having a leading surface;

a plurality of cutting elements affixed onto said leading surface; and each of said cutting elements is an irregular polyhedron having a first face, a second face, a third face, a fourth face, a fifth face, a sixth face, a seventh face, an eighth face, and a ninth face;

each of said first through nine faces having a predetermined distance from each of said nine faces to an opposing cutting edge of each of said nine faces; and, said predetermined distance is equal for each of said nine faces.

11. The cutting tool of claim 10 wherein said plurality of cutting elements have a uniform height across said leading surface of said cutting tool.

12. The cutting tool of claim 10 wherein said plurality of cutting elements have a variable height across said leading surface of said cutting tool.

13. The cutting tool of claim 10 wherein said plurality of cutting elements is affixed onto said leading surface of said longitudinal body by affixing said plurality of cutting elements to a metal bar and by affixing said bar onto said leading surface of said longitudinal body.

14. The cutting tool of claim 10 wherein said plurality of cutting elements is affixed onto said leading surface of said longitudinal body by affixing said plurality of cutting elements to a plate and by affixing said plate onto said leading surface of said longitudinal body.

15. A method of cutting through material in a drilled hole such as an oil or gas well, the method comprising:

obtaining a cutting tool which has a front portion and a rear portion, said front portion having a leading surface;

affixing a plurality of nine-faced cutting elements onto said leading surface;

wherein each of said cutting elements is an irregular polyhedron having a first face, a second face, a third face, a fourth face, a fifth face, a sixth face, a seventh face, an eighth face, and a ninth face;

wherein each of said first through nine faces having a predetermined distance from each of said nine faces to an opposing cutting edge of each of said nine faces;

wherein said predetermined distance is equal for each of said nine faces;

inserting said cutting tool into a well or pipe;

rotating said cutting tool into said well or pipe;

wherein said cutting elements cut through material to be removed from said well or pipe.

16. The method of claim 15 wherein said affixing is by welding, bonding, or brazing.

17. The method of claim 15 wherein said cutting elements are applied randomly onto said leading surface and said cutting elements are the same height from said leading surface.

* * * * *